US005458060A

United States Patent [19]

Casl

[11] Patent Number: 5,458,060

[45] Date of Patent: Oct. 17, 1995

[54] SCREEN PRINTING SQUEEGEE SYSTEM

[75] Inventor: Slobodan Casl, Williamstown, N.J.

[73] Assignee: Sony Electronics Inc.

[21] Appl. No.: 226,121

[22] Filed: Apr. 11, 1994

Related U.S. Application Data

[63] Continuation-in-part of Ser. No. 57,059, May 3, 1993, abandoned.

[51] Int. Cl.[6] ..... B41F 15/40; B41F 15/44

[52] U.S. Cl. ..... 101/123; 101/120; 101/124; 15/245

[58] Field of Search ..... 15/245, 256.5, 15/256.51; 101/119–124, 154, 155, 157, 166, 169, 416.1, 423, 425; 24/525, 528, 535, 543, 569

[56] References Cited

U.S. PATENT DOCUMENTS 3,307,235 2/1965 Hennings .
3,986,746 10/1976 Cartier .
4,051,777 10/1977 Black et al. .
4,080,893 3/1978 Widell .
4,122,771 10/1978 Barton et al. .
4,638,733 1/1987 Schneider et al. .
4,700,437 10/1987 Hoshino .
4,805,938 2/1989 Redmond et al. .
5,078,063 1/1992 Johansen et al. .

*Primary Examiner*—Edgar S. Burr
*Assistant Examiner*—Lynn D. Hendrickson
*Attorney, Agent, or Firm*—Peter C. Toto; Jerry A. Miller

[57] ABSTRACT

An improved squeegee holder for screen printing. A squeegee with a diamond or square shaped portion is clamped between two clamping plates inside V-shaped grooves in the clamping plates. Corner relief portions are provided within the clamping plates so that the corners not in use are not damaged. The clamping plates are aligned by two alignment pins and screwed together by a threaded rod with a handle. A spring surrounds each of the alignment pins urging the two clamping plates apart so that they separate when the screw handle is loosened.

26 Claims, 6 Drawing Sheets

SCREEN PRINTING SQUEEGEE SYSTEM

This is a continuation-in-part of U.S. Ser. No. 08/057,059, filed May 3, 1993, now abandoned, which is hereby incorporated by reference.

BACKGROUND

1. Field of the Invention

This invention relates generally to the field of screen printing squeegees. More particularly, the present invention relates to a screen printing squeegee system using a quick-release clamping means to hold a squeegee having at least a diamond shaped cross section portion. This combination provides for quick change or rotation of the squeegee and utilization of a plurality of sides or corners of the squeegee.

2. Background of the Invention

In screen printing, there are many variables which effect the printing quality. For example the squeegee's durometer, sharpness and angle must be optimized to obtain good results. Most common squeegee holders are similar to the squeegee holder 15 shown in FIG. 1. In the squeegee holder of FIG. 1, a squeegee 20 having a wide rectangular cross section is clamped between two clamping plates 24 and 26 to expose a printing bottom edge of the squeegee 20. The squeegee 20 is held in place by aligning the squeegee 20 and then tightening a plurality of bolts 34 to secure the squeegee 20 in place. One of the most important factors determining print quality is the alignment of the squeegee with the substrate being printed.

For squeegee holders such as that shown in FIG. 1, tools are required to tighten bolts 34 whenever the squeegee is replaced. Whenever it is replaced, the alignment of the squeegee must be adjusted. To achieve quality printing with consistent results, a properly aligned edge 30 of the squeegee 20 is essential. If this edge is not even, uneven deposits of ink results with color variation and smearing or partial prints. Currently, this bottom edge 30 of the squeegee is aligned by eye. Since tools are required to adjust the alignment of the squeegee holder, adjusting the squeegee for proper alignment is cumbersome and time consuming.

Squeegees such as squeegee 20 are frequently sharpened to increase their life and avoid the need to adjust their alignment. However, the material that such squeegees are made of are frequently sensitive to the heat which might be generated during the sharpening process. After sharpening, the squeegee may no longer be protected against solvents such as acetone, alcohol and sometimes the ink itself. The result is often dimensional changes or premature softening of the squeegee material. Thus sharpening is not really advisable.

Referring to FIG. 2, the squeegee holder and squeegee of FIG. 1 is shown in operation. The entire assembly 15 is tilted to the right at approximately 15° (generally between 10° and 20° ) as indicated by angle 40. Downward pressure is then applied to the assembly 15 as the squeegee is pulled across a screen 44 in the direction of travel shown. The squeegee 20 wipes ink across the screen 44 which is anchored at two points 46 and 48. Ink is then deposited through mesh openings in the screen 44 on to the substrate 50 being printed. In the case of the present invention, the substrate 50 is a compact disc. This printing process is used to produce label information and decorative patterns or images on the compact disc.

Referring to FIG. 3, the angle 40 is typically set at between 10° and 20°, with 15° being a typical angle. The downward pressure exerted on the squeegee holder deforms the squeegee edge 30 to produce a true printing angle 60 of approximately 40° at the contact edge 30 due to the deformation of the squeegee.

Screen 44 is a fabric screen with openings in the mesh through which ink is deposited on the substrate 50. The quantity of ink deposited is controlled by the mesh opening, thickness of the fabric, thickness of the emulsion, snap-off distance between the screen and substrate, squeegee wiper durometer, squeegee wiper blade sharpness and squeegee angle. The downward pressure is generally created manually or with air pressure or other mechanical pressure.

Because the top edge 32 of the squeegee 20 is subjected to both the downward pressure exerted on the squeegee holder and the pressure applied by clamping plates 24 and 26, it is possible that the top edge 32 will be damaged while the bottom edge 30 is in use. This could require the top edge 32 be sharpened before use or simply result in the top edge 32 not being usable. In the latter case, the useful life of the squeegee is cut in half. In the former case, the deleterious effects of sharpening described above as well as the additional time required for accomplishing the same must be endured.

Furthermore, with the system shown in FIGS. 1 through 3, the critical adjustment of the squeegee 20 is carried out manually by eye and additional tools are required. This is a time consuming process which can obviously result in inconsistent quality.

U.S. Pat. No. 4,122,771 discloses a squeegee holder wherein the squeegee is held by two jaws at a canted diagonal alignment, so that a corner edge of the squeegee is exposed beneath the jaws. While this type of holder remedies some of the alignment problems of previous devices, this holder suffers from the disadvantage that the two jaws are held together by screws or bolts, such as bolts 34 in FIG. 1. Again, this necessitates the use of additional tools and time when the squeegee is to be changed. Furthermore, such a holder suffers from the additional disadvantage that the corners of the three sides not exposed beneath the jaws (i.e., the corners not being used for printing) are all in contact with the jaws. Thus, these sensitive corner areas are subjected to the applied downward force and/or the forces holding the jaws together and that applied during use. As a result, these corners can be damaged before being used, sharply decreasing the possible usable lifespan of the squeegee, or requiring that the squeegee be subjected to the deleterious effects of sharpening before using a damaged corner.

The present invention seeks to improve the print quality in an improved squeegee holding system which provides consistent alignment and rapid change of the squeegee as well as for extending the possible useful life of the squeegee.

SUMMARY OF THE INVENTION

It is an object of the present invention to provide an improved squeegee holding system.

It is a feature that the present invention provides rapid insertion and removal of the squeegee with correct alignment.

It is an advantage that the present invention allows use of all four corners or multiple sides of a squeegee having at least a diamond shaped portion with no need for sharpening.

It is a further advantage that the quick release mechanism of the present invention requires no tools to change or rotate the squeegee blade.

These and other objects, advantages and features of the invention will become apparent to those skilled in the art upon consideration of the following description of the invention.

In one embodiment of the present invention an improved squeegee holder for screen printing includes a diamond or square shaped squeegee which is clamped between two clamping plates inside V-shaped grooves in the clamping plates. Preferably, the V-shaped grooves have corner portions removed (corner relief portions), which are essentially U-shaped channels built into the grooves to avoid pinching of the corners. Furthermore, advantageously the top corner, the corner opposing the printing surface, is not in contact with the clamping plates. Thus, these three corners (the three corners not in use) are not subjected to the forces associated with the clamps and the printing operation, and all four printing edges can be used without sharpening. This results in a substantial savings of material costs.

The clamping plates are aligned by two alignment pins and screwed together by a threaded rod with a handle. A spring surrounds each of the alignment pins urging the two clamping plates apart so that they separate when the screw handle is loosened.

In another embodiment of the present invention, a screen printing squeegee system includes a squeegee having a diamond shaped cross section portion with four corners, a first substantially rectangular shaped cross section portion adjacent a first of said four corners and a second substantially rectangular shaped cross section portion adjacent a second of said four corners, said first and second corners being opposing corners. A first clamping plate has a first bottom edge and a first V-shaped groove along the bottom edge. A second clamping plate has a second bottom edge and a second V-shaped grove along the bottom edge. A clamping system attaches the first and second clamping plate together with the two opposing corners of the squeegee clamped within the first and second V-shaped grooves. One of the substantially rectangular shaped cross section portions of the squeegee extends below the first and second bottom edges for printing. Preferably, the other of the rectangular shaped portions is not in contact with the clamping plates during operation of the system to ensure that it can readily be used for printing.

The features of the invention believed to be novel are set forth with particularity in the appended claims. The invention itself however, both as to organization and method of operation, together with further objects and advantages thereof, may be best understood by reference to the following description taken in conjunction with the accompanying drawing.

DETAILED DESCRIPTION OF THE INVENTION

Figure 1:
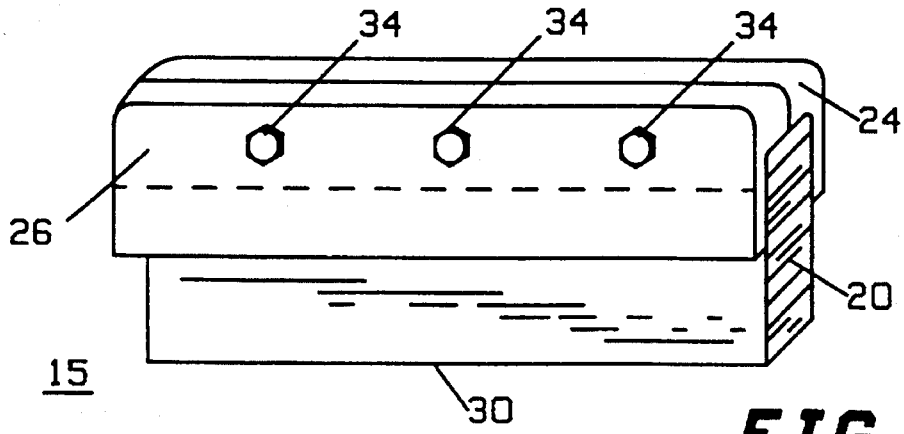
FIG. 1 PRIOR ART
FIG. 1 is a perspective view of a squeegee holder of the prior art.

While this invention is susceptible of embodiment in many different forms, there is shown in the drawings and will herein be described in detail specific embodiments, with the understanding that the present disclosure is to be considered as an example of the principles of the invention and not intended to limit the invention to the specific embodiments shown and described.

Figure 4:
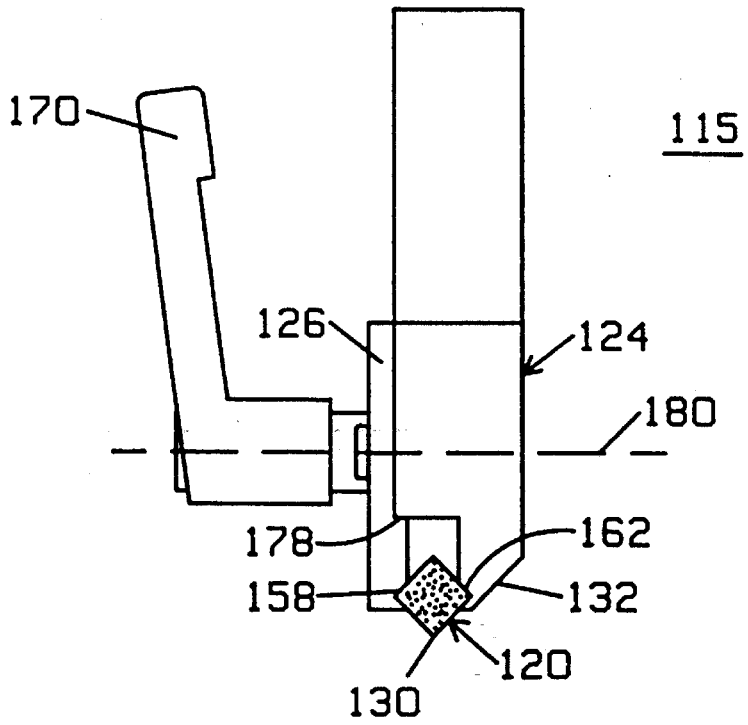
FIG. 4 is a side view of the squeegee holder of the present invention.

Referring now to FIG. 4, the improved screen printing squeegee system 115 of the present invention is shown in a side view. The squeegee 120 of the present invention is clamped between clamping plates 124 and 126. Squeegee 120 has a square cross section (or diamond shaped cross section) approximately 0.375 inch on each side with 90° corners. The bottom corner 130 is exposed to wipe the ink across the screen. In order to assure a proper exposure of this bottom edge when the squeegee is tilted, a bottom portion of clamping plate 124, shown as 132, is chamfered to avoid contact of the clamp plate with the screen 44. In order to consistently clamp the squeegee 120 in proper alignment with the surface being printed, the inside surfaces of clamping plates 124 and 126 include 90° V-shaped channels 158 and 162 which are opposed to one another and which grab the sides of the diamond shaped squeegee 120.

In order to tighten clamping plate 124 with clamping plate 126, a handle 170 is rotated to pull the two clamping plates into engagement. When the clamping plates meet, the squeegee is clamped by the proper amount of pressure and is aligned. The upper portion of plate 126 is rabbeted so that alignment of the clamping plates is partially controlled at corner 178. As shown, when the clamping plates are tightened, a gap exists between the plates so as to provide that the top corner 134 of the squeegee is not in contact with the clamping plates. This prevents the top corner from being damaged during printing with the bottom corner 130.

Figure 5:
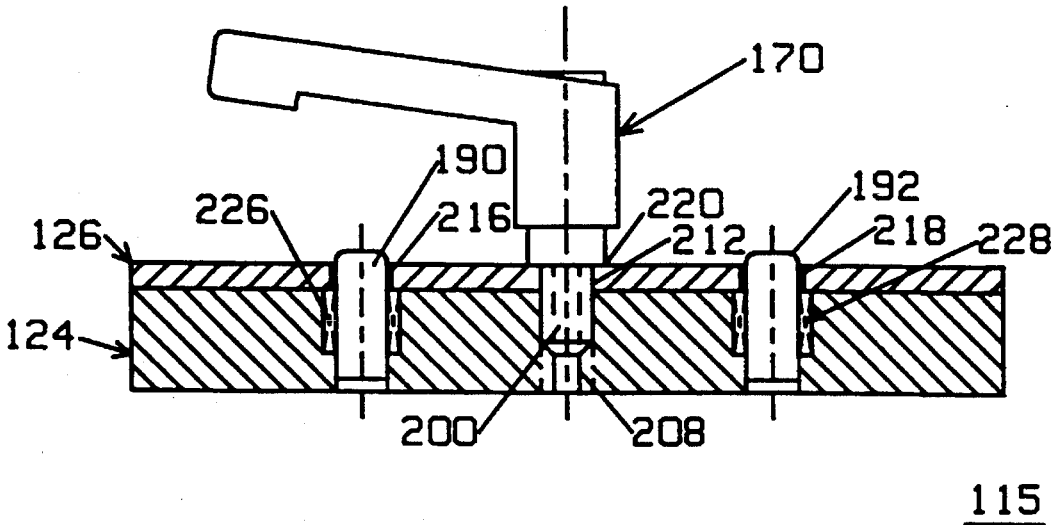
FIG. 5 is a cross sectional view of the squeegee holder of FIG. 4.

Squeegee holder 115 is shown along cross section line 180 in FIG. 5. Additional alignment of the clamping plates 124 and 126 is provided by a pair of alignment pins 190 and 192. These alignment pins are press fit or otherwise securely attached into one of the clamping plates (in this case clamping plate 124) so that the area 178 of FIG. 4 as well as two clamping pins 192 maintain proper alignment of the two clamping plates. The pins could also be floating inside mortises in other embodiments.

The two clamping plates 124 and 126 are clamped together by advancing a threaded rod 200 through a threaded aperture 208 in the clamping plate 124. The threaded rod is attached to handle 170 and passes through an unthreaded aperture 212 in clamping plate 126. Alignment pins 190 and 192 similarly pass through apertures 216 and 218 in the clamping plate 126. When the squeegee 120 is properly placed in the V-shaped grooves 158 and 162, the pins 190 and 192 are already engaged in apertures 216 and 218. Handle 170 is then rotated to advance the threaded rod 200 through threaded aperture 208. The bottom surface 220 of handle 170 then presses against the outside surface of the clamping plate 126, urging it into engagement with clamping plate 124.

When the clamping plate 126 is to be released from clamping plate 124, handle 170 is rotated in the opposite direction so that threaded rod 200 backs out of the threaded aperture 208. A pair of springs 226 and 228 urge the clamping place 226 away from clamping plate 224 to release the squeegee 120.

Since the squeegee 120 is rectangular or diamond shaped in cross section, all four corners of the squeegee can be used before the squeegee has to be replaced and no sharpening is typically necessary. Rotation of the squeegee 120 is, of course, accomplished by loosening handle 170 until the squeegee 120 is removable, removing the squeegee, rotating it to expose an unused side, placing it back within the V-shaped grooves and tightening the clamping plates back in place. Alignment takes place in seconds without need for guesswork on the part of the operator.

Figure 8:
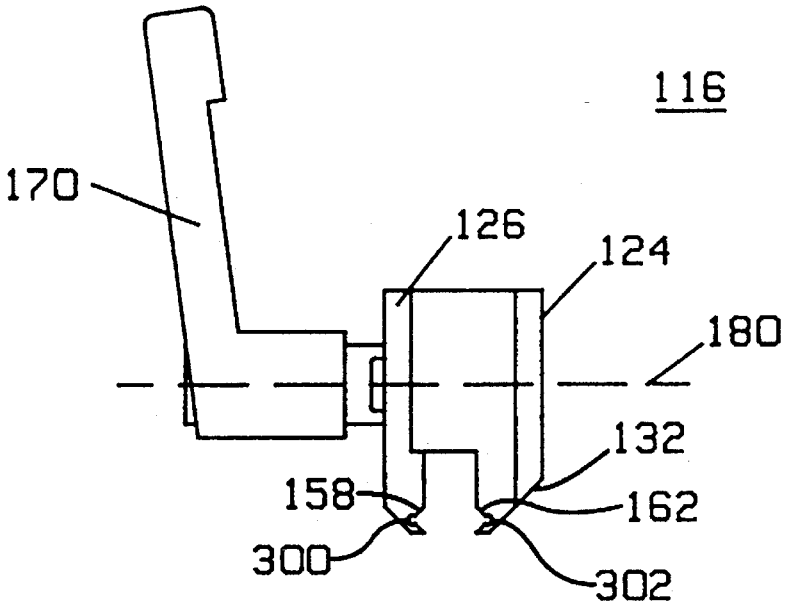
FIG. 8 is a side view of the squeegee holder of the present invention including corner relief portions.
Figure 9:
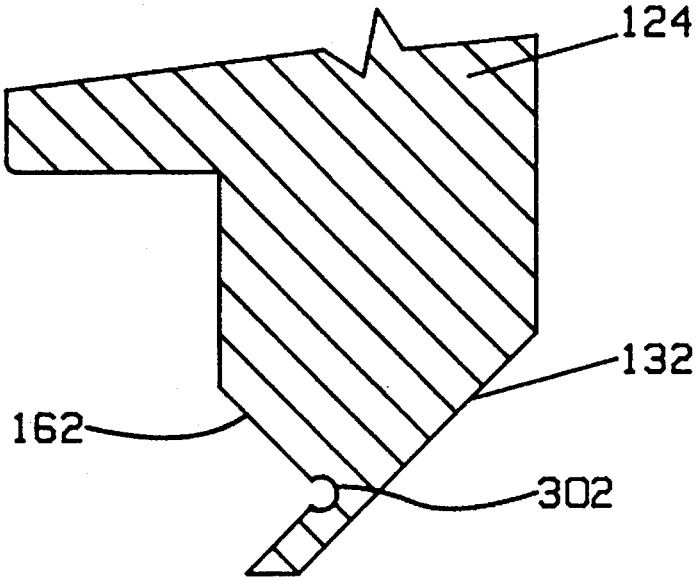
FIG. 9 is a detailed view of one of the corner relief portions of the squeegee holder of FIG. 8.

FIG. 8 shows an improved squeegee printing system 116 which is the same as system 115 of FIG. 4 except that corner relief portions 300 and 302 are shown. FIG. 9 shows a more detailed view of corner relief portion 302. This corner relief portion is approximately a one-sixteenth of an inch U-shaped channel cut out of the corner of clamping plate 124. Corner relief portion 300 is identical to corner relief portion 302 except that it is cut out of clamping plate 126.

Figure 10:
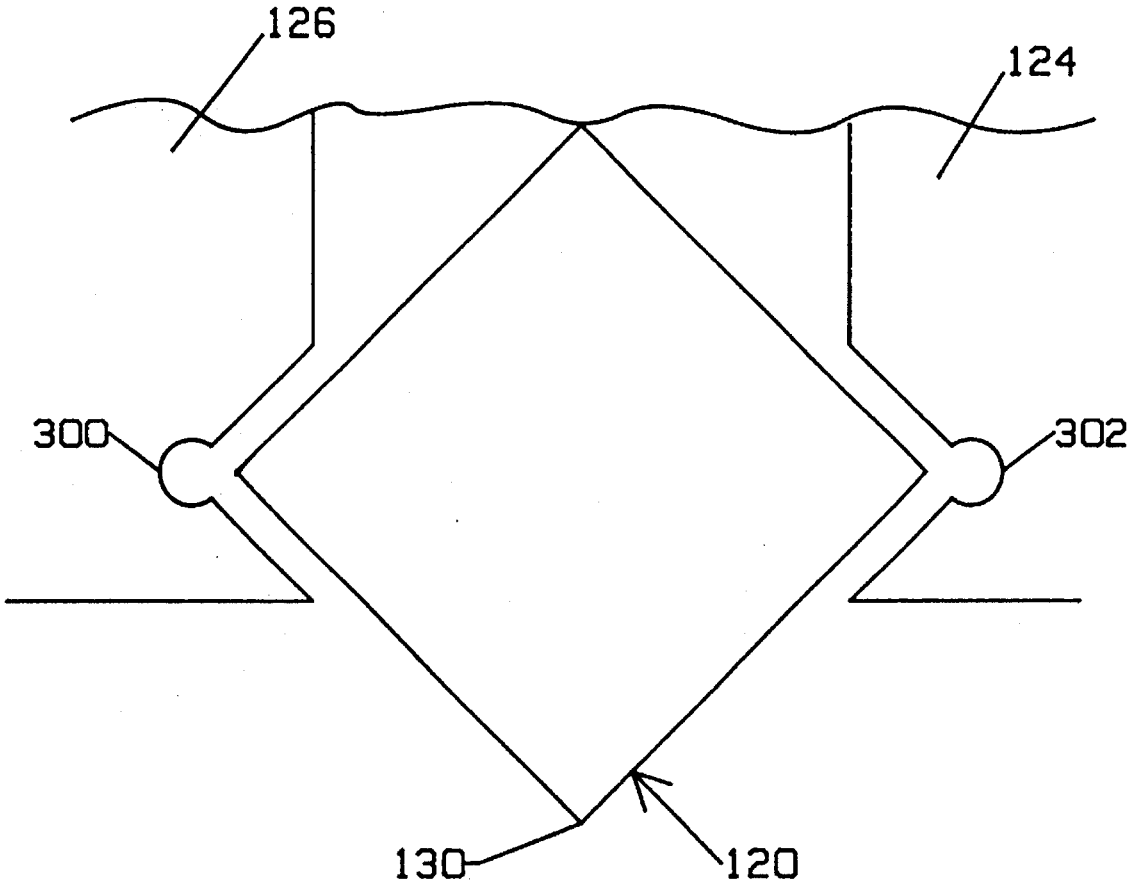
FIG. 10 is a detailed view of the contact between a diamond shaped squeegee and the squeegee holder of FIG. 8.

FIG. 10 shows the squeegee printing system of FIG. 8 just prior to the handle 170 (FIG. 8) being fully tightened. As can be observed from FIG. 10, when the handle is tightened there can be no pressure on any of the corners (except, of course, for the bottom corner 130 when the device is in use). Rather, the pressure will be applied along the four sides of the squeegee. Accordingly, the corners not in present use for printing will not be damaged and all four corners will therefore be usable for printing without first sharpening. This feature, in combination with the quick-change alignment means described above, provides for a long lasting squeegee and little down time for the system.

Figure 6:
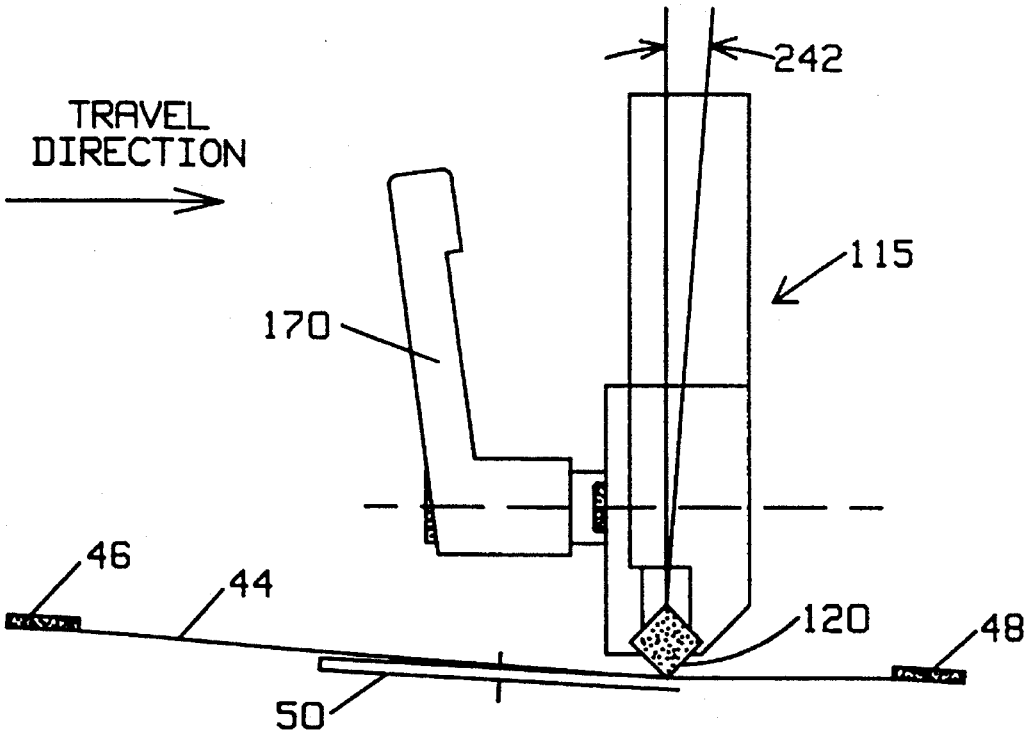
FIG. 6 is a view of the squeegee holder of the present invention in operation.
Figure 7:
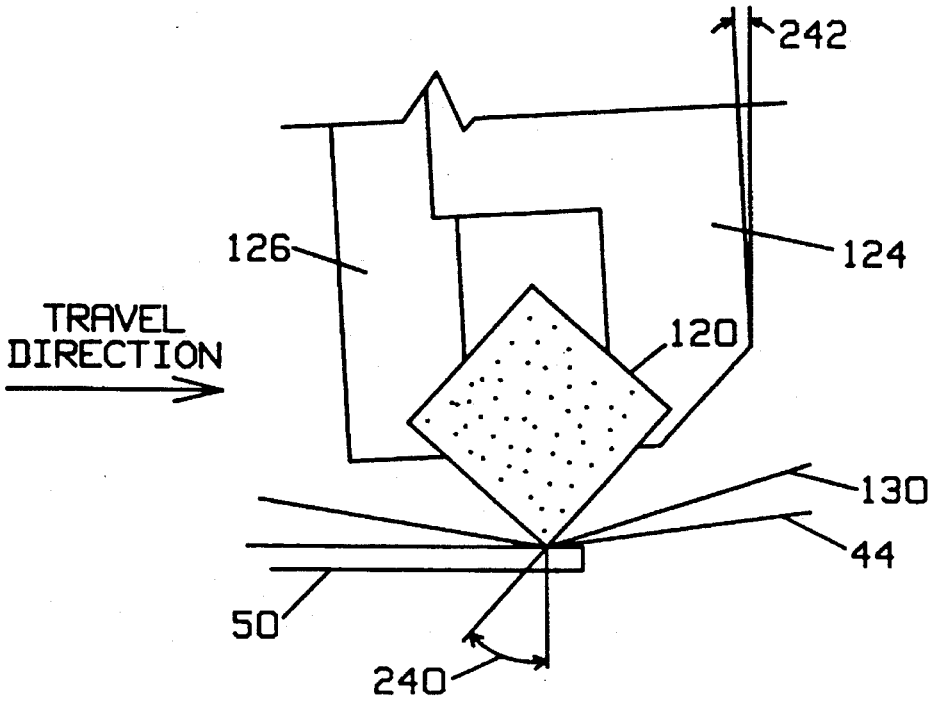
FIG. 7 is a detailed view of the squeegee holder of the present invention at the point of contact with the screen.

Referring to FIG. 6, the squeegee system 115 of the present invention is shown in operation. The detailed view of FIG. 7 shows the contact of the squeegee edge 130 with the screen 44. In order to achieve a similar 40° true print angle 240, the squeegee holder of the present invention is tilted approximately 5° to the left at angle 242 with the same direction of travel. Note that the present squeegee holder is tilted in the opposite direction as the prior art squeegee holder to achieve approximately the same print angle. Of course, in other environments, the 40° true print angle may be inappropriate. In these cases, the tilt of the squeegee holder 115 is adjusted to suitably produce the best print angle. The squeegee system 116 is designed to be used in identical fashion.

Figure 2:
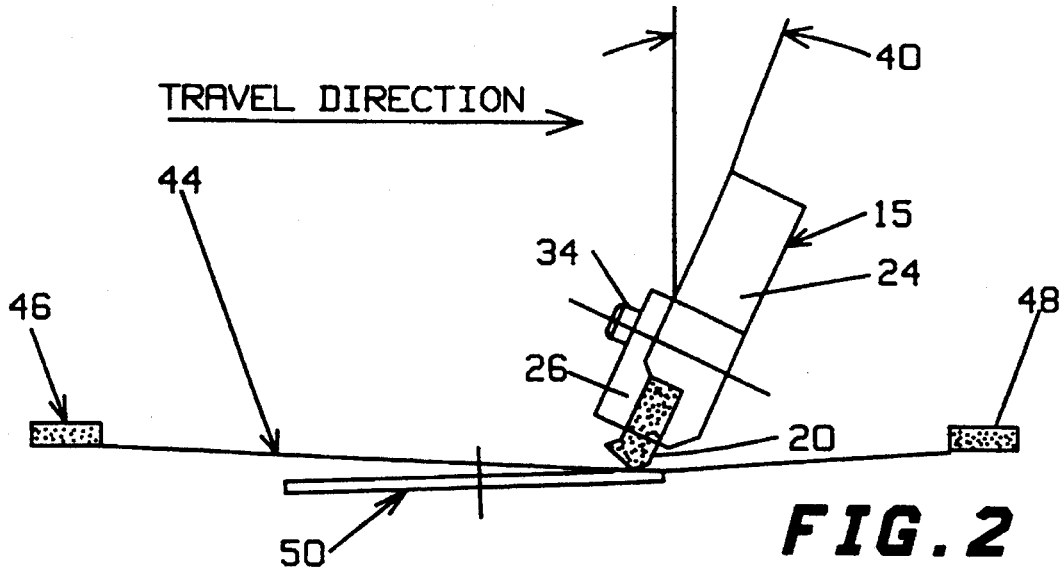
FIG. 2 PRIOR ART
FIG. 2 is an illustration of the prior art squeegee holder in operation.
Figure 3:
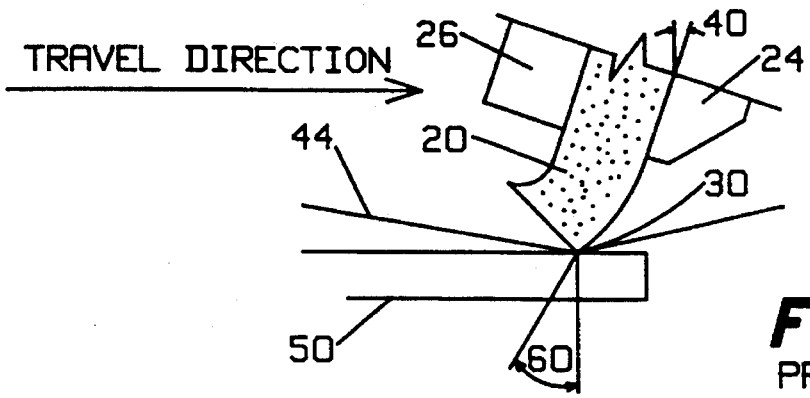
FIG. 3 PRIOR ART
FIG. 3 is a detailed view of the contact between the squeegee and the screen and substrate of the prior art.
Figure 11:
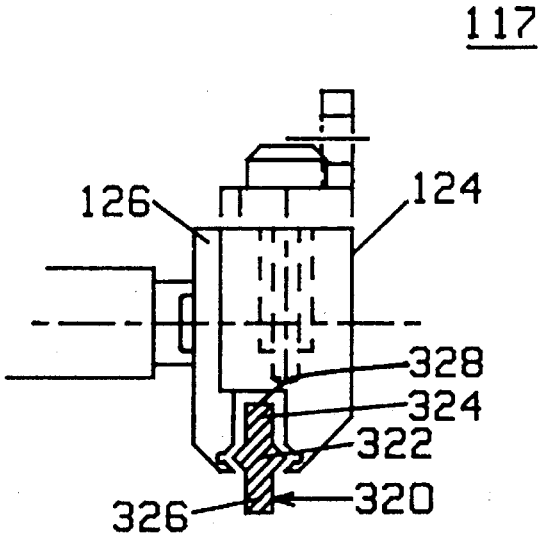
FIG. 11 is a view of the contact between an alternative design squeegee and the squeegee holder of FIG. 4 or 8.

As known by those skilled in the art, in some printing applications it has been found desirable to employ a squeegee having a rectangular printing surface such as that of prior art squeegee 20 of FIGS. 1–3. FIG. 11 shows an improved squeegee printing system 117 having a squeegee 320 with a diamond shaped cross section portion 322 in the middle of two rectangular shaped cross section portions 324,326. All four corners 350, 352, 354 and 356 can be used for printing in a fashion exemplified by FIGS. 2 and 3. The remaining portions of the system are identical to that shown in FIG. 4. As such, when one of the rectangular portions of the squeegee wears out, e.g., the two corners 350, 352 in contact with the printing surface wear out, the squeegee can be quickly flipped-over via the quick-change handle and proper alignment is assured via the diamond shaped central portion. Note that in this embodiment, since the diamond shaped portion is not used for printing, corner relief sections are not required. However, a space is still provided between top surface 328 and the clamping plates so that the top surface 328 is not damaged when printing with the opposing surface.

Figure 12:
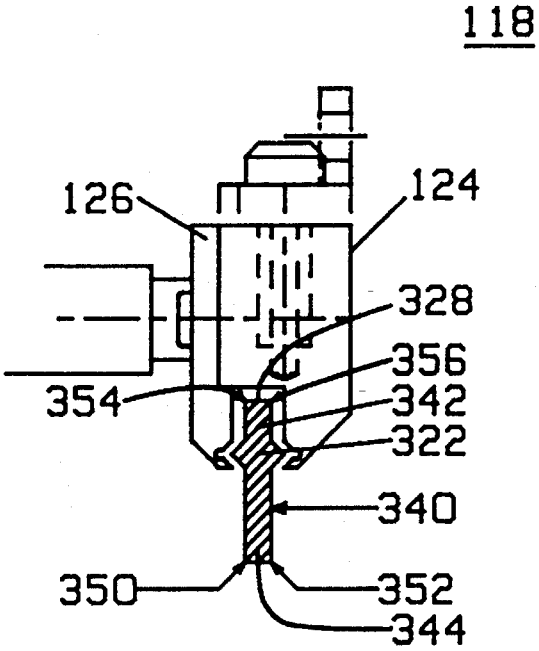
FIG. 12 is a view of the contact between another alternative design squeegee and the squeegee holder of FIG. 4 or 8.

FIG. 12 is identical to FIG. 11 except that it employs a squeegee 340 with unequal length rectangular portions 342 and 344. This type of squeegee is useful in certain printing arrangements as known by those skilled in the art.

Those skilled in the art will appreciate numerous variations of the present invention upon consideration of the present discussion. For example, while the present invention utilizes V-shaped grooves which are approximately 90° to accommodate a square cross sectional squeegee, squeegees with other angles can similarly be accommodated by adjusting the angle of the V-shaped grooves. Also, while the present invention utilizes a handle 170 coupled to a threaded rod 200 to pull clamping plates 124 and 126 into engagement, other mechanisms for clamping the two plates together could be utilized such as a cam operated clamping mechanism. In the present invention, squeegees having durometer between 70 and 100 and made of polyurethane or polyeter are utilized with excellent results. Other materials and durometers could also be utilized depending upon the other variables present in the printing operation.

Thus it is apparent that in accordance with the present invention, an apparatus that fully satisfies the objectives, aims and advantages is set forth above. While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations as fall within the scope of the appended claims.

What is claimed is:

1. A screen printing squeegee system comprising:

a squeegee having a diamond shaped cross section with four corners;

a first clamping plate having a substantially V-shaped groove along a bottom edge;

a second clamping plate having a substantially V-shaped grove along a bottom edge; and clamping means for attaching said first and second clamping plates together with two opposing corners of said squeegee clamped within said first and second V-shaped grooves with a third of said four corners, which opposes a fourth of said four corners, extending below said bottom edges, said clamping means including a movable, elongated handle to urge said first and second clamping plates against one another when the handle is moved by a user in a first direction, wherein at least one of said two opposing corners of said squeegee clamped within said first and second V-shaped grooves and said fourth corner are free of contact with said first and second clamping plates during operation of said system.

2. The screen printing squeegee system according to claim 1, wherein said fourth of said four corners is free of contact with said first and second clamping plates during operation of said system.

3. The screen printing squeegee as in claim 1, wherein said clamping means further includes:

a threaded rod passing through an aperture in said first clamping plate and threaded into a threaded hole in said second clamping plate; and wherein the handle is attached to said threaded rod with a surface bearing against said first clamping plate adjacent said aperture to urge said first and second clamping plates against one another when said threaded rod is advanced through said threaded hole upon movement of the handle in the first direction.

4. The screen printing squeegee as in claim 3, further comprising an alignment means for aligning said first and second V-shape grooves.

5. The screen printing squeegee as in claim 4, further comprising a spring, forming a part of said alignment means, for urging said first and second clamping plates apart when said threaded rod is threaded out of said threaded hole upon movement of the handle in a second direction.

6. The screen printing squeegee as in claim 4, wherein said alignment means includes a pair of alignment pins.

7. The screen printing squeegee as in claim 4, wherein said alignment means includes a pair of alignment pins each surrounded by a spring urging said first and second clamping plate apart.

8. The screen printing squeegee as in claim 6, wherein said alignment pins are attached to said second clamping plate and pass through apertures in said first clamping plate to achieve alignment of said V-shaped grooves.

9. A screen printing squeegee system comprising:

a squeegee having a diamond shaped cross section with four corners;

a first clamping plate having a substantially V-shaped groove along a bottom edge;

a second clamping plate having a substantially V-shaped groove along a bottom edge; and clamping means for attaching said first and second clamping plates together with two opposing corners of said squeegee clamped within said first and second V-shaped grooves with a third of said four corners extending below said bottom edges, said V-shaped grooves having corner portions removed so that said two opposing corners of said squeegee clamped within said first and second V-shaped grooves are not in contact with said first and second clamping plates during operation of said system.

10. The screen printing system according to claim 9, wherein a fourth of said four corners, which opposes said third corner, is free of contact with said first and second clamping plates during operation of said system.

11. The screen printing system according to claim 9, wherein said clamping means includes a movable, elongated handle to urge said first and second clamping plates against one another when the handle is rotated by a user in a first direction.

12. The screen printing system according to claim 11, wherein said clamping means further includes;

a threaded rod passing through an aperture in said first clamping plate and threaded into a threaded hole in said second clamping plate; and wherein the handle is attached to said threaded rod with a surface bearing against said first clamping plate adjacent said aperture to urge said first and second clamping plates against one another when said threaded rod is advanced through said threaded hole upon movement of the handle in the first direction.

13. The screen printing system according to claim 12, further comprising an alignment means for aligning said first and second V-shape grooves.

14. The screen printing system according to claim 13, further comprising a spring, forming a part of said alignment means, for urging said first and second clamping plates apart when said threaded rod is threaded out of said threaded hole upon movement of the handle in a second direction.

15. The screen printing system according to claim 13, wherein said alignment means includes a pair of alignment pins.

16. The screen printing system according to claim 13, wherein said alignment means includes a pair of alignment pins each surrounded by a spring urging said first and second clamping plate apart.

17. The screen printing system according to claim 15, wherein said alignment pins are attached to said second clamping plate and pass through apertures in said first clamping plate to achieve alignment of said V-shaped grooves.

18. The screen printing system according to claim 9, wherein said V-shaped grooves having corner portions removed have U-shaped corner portions removed.

19. A screen printing squeegee system comprising:

a squeegee having a diamond shaped cross section portion with four corners, a first substantially rectangular shaped cross section portion adjacent a first of said four corners and a second substantially rectangular shaped cross section portion adjacent a second of said four corners, said first and second corners being opposing corners;

a first clamping plate having a substantially V-shaped groove along a bottom edge;

a second clamping plate having a substantially V-shaped groove along a bottom edge; and clamping means for attaching said first and second clamping plates together with a third and fourth of said four corners of said squeegee clamped within said first and second V-shaped grooves, wherein one of said substantially rectangular shaped cross section portions of said squeegee extends below said bottom edges and the other of said substantially rectangular shaped cross section portions of said squeegee is free of contact with said first and second clamping plates during operation of said system.

20. The screen printing system according to claim 19, wherein said clamping means includes a movable, elongated handle to urge said first and second clamping plates against one another when the handle is moved by a user in a first direction.

21. The screen printing system according to claim 20, further comprising an alignment means for aligning said first and second V-shape grooves.

22. The screen printing system according to claim 21, further comprising a spring, forming a part of said alignment means for urging said first and second clamping plates apart when said threaded rod is threaded out of said threaded hole upon movement of the handle in a second direction.

23. The screen printing system according to claim 21, wherein said alignment means includes a pair of alignment pins.

24. The screen printing system according to claim 21, wherein said alignment means includes a pair of alignment pins each surrounded by a spring urging said first and second clamping plate apart.

25. The screen printing system according to claim 23, wherein said alignment pins are attached to said second clamping plate and pass through apertures in said first clamping plate to achieve alignment of said V-shaped grooves.

26. The screen printing system according to claim 19 wherein the rectangular shaped cross section portions are of different lengths.

* * * * *